US010519747B2

(12) United States Patent
Purkis

(10) Patent No.: US 10,519,747 B2
(45) Date of Patent: Dec. 31, 2019

(54) PRESSURE OPERATED VALVE ASSEMBLY

(71) Applicant: Weatherford U.K. Limited, Leicestershire (GB)

(72) Inventor: Daniel George Purkis, Leicestershire (GB)

(73) Assignee: WEATHERFORD U.K. LIMITED (GB)

( * ) Notice: Subject to any disclaimer, the term of this patent is extended or adjusted under 35 U.S.C. 154(b) by 221 days.

(21) Appl. No.: 15/509,467

(22) PCT Filed: Sep. 17, 2015

(86) PCT No.: PCT/GB2015/052685
§ 371 (c)(1),
(2) Date: Mar. 7, 2017

(87) PCT Pub. No.: WO2016/042328
PCT Pub. Date: Mar. 24, 2016

(65) Prior Publication Data

US 2017/0275968 A1 Sep. 28, 2017

(30) Foreign Application Priority Data

Dec. 19, 2014 (GB) ..... 1422706.0

(51) Int. Cl.
*E21B 34/10* (2006.01)
*E21B 23/04* (2006.01)
*E21B 34/00* (2006.01)

(52) U.S. Cl.
CPC ..... *E21B 34/103* (2013.01); *E21B 23/04* (2013.01); *E21B 2034/007* (2013.01)

(58) Field of Classification Search
CPC ..... E21B 34/101–103
See application file for complete search history.

(56) References Cited

U.S. PATENT DOCUMENTS 3,412,806 A 11/1968 Fredd et al.
5,167,284 A 12/1992 Leismer
(Continued)

FOREIGN PATENT DOCUMENTS

GB 1569081 A 6/1980
GB 2492193 A 12/2012
(Continued)

OTHER PUBLICATIONS

Int'l Search Report and Written Opinion in counterpart PCT Appl. PCT/GB2015/052685, dated Nov. 27, 2015, 10-pgs.
(Continued)

*Primary Examiner* — D. Andrews
(74) *Attorney, Agent, or Firm* — Blank Rome, LLP

(57) ABSTRACT

A valve assembly comprises an actuation fluid inlet, an actuation fluid outlet and a valve member moveable between a closed position in which the actuation fluid outlet is closed, and an open position in which the actuation fluid outlet is opened. A locking arrangement is provided for locking the valve member in its closed position, wherein the locking arrangement is operable in response to a first predetermined fluid pressure event associated with at least the actuation fluid inlet to release the locking arrangement to permit the valve member to be moved to its open position in response to a second subsequent predetermined fluid pressure event associated with at least the actuation fluid inlet.

27 Claims, 9 Drawing Sheets

(56) References Cited

U.S. PATENT DOCUMENTS

| | | | | |
|---|---|---|---|---|
| 6,230,807 | B1 | 5/2001 | Patel | |
| 6,354,374 | B1 | 3/2002 | Edwards et al. | |
| 6,378,612 | B1 * | 4/2002 | Churchill | E21B 21/103 166/319 |
| 6,397,949 | B1 | 6/2002 | Walker | |
| 7,264,059 | B2 | 9/2007 | Akselberg | |
| 7,516,792 | B2 | 4/2009 | Lonnes et al. | |
| 2012/0042966 | A1 | 2/2012 | Ross | |
| 2017/0275968 | A1 | 9/2017 | Purkis | |

FOREIGN PATENT DOCUMENTS

| | | | |
|---|---|---|---|
| WO | 00/29715 | A1 | 5/2000 |
| WO | 2014/035252 | A1 | 3/2014 |

OTHER PUBLICATIONS

Search Report in counterpart UK Appl. GB1422706.0, dated Apr. 21, 2015, 4-pgs.
Search Report in counterpart UK Appl. GB1516484.1, dated May 3, 2016, 3-pgs.
Australian Examination Report in counterpart AU Appl. 2015316607, dated Jul. 8, 2019, 3-pgs.

* cited by examiner

PRESSURE OPERATED VALVE ASSEMBLY

FIELD

The present invention relates to a pressure operated valve assembly, and in particular to a downhole pressure operated valve assembly

BACKGROUND

In downhole oil and gas operations downhole equipment, such as downhole valves, sleeves, ICDs, packers, slips, toe sleeves and the like may be operated by use of pressure. For example, some equipment may be operated by use of hydrostatic pressure within the wellbore. In some cases equipment may be actuated by use of pressure differentials, for example between internal tubing pressure and external annulus pressures.

In some known downhole equipment, actuation requires direct use or exposure to downhole fluids, such as annulus fluids. This therefore involves the risk of contamination of the equipment due to particulate matter and the like. This may compromise proper functionality of the equipment, possibly leading to the requirement for workover or intervention operations, which are costly.

It is often the case in downhole operations that a defined sequence of events is required. However, if each event is pressure initiated, then there is a risk of the sequence being upset by a premature reaction of one event or device to a pressure meant for operation of a different event or device. For example, pressure testing is often required in downhole operations, such as to confirm the pressure integrity of completion strings following and/or during deployment. However, should the completion include one or more pressure activated devices then there is a risk that such devices are inadvertently actuated during pressure testing.

Some solutions which seek to ensure correct operational sequencing are known in the art. Some known systems may rely on devices being locked in an initial position, wherein the lock becomes released following a set sequence of events in the well, for example a set sequence of pressures. However, in many cases the lock may be designed to be released upon application of very high elevated pressures, which may even exceed those pressures required for other operations, such as test operations. Such high pressures could lead to compromise of otherwise sound seals and the like.

Electronic solutions are known, which include pressure sensors and controllers which only permit actuation, for example by releasing an initial lock mechanism, following a necessary pressure sequence, such as a pressure test sequence. However, such electronic solutions in some cases may be relatively complex, often requiring the use of sensitive electronics which may be prone to failure in the harsh downhole environment. Further, electronic solutions require a power source, adding to the complexity.

Other solutions may include mechanical arrangements which facilitate operation of downhole devices following a sequence of pressures. Some examples are disclosed in U.S. Pat. Nos. 7,516,792, 6,354,374, 6,230,807 and 7,264,059.

It is also known in the art to include burst disk arrangements, which can initially hold pressure up to their pressure rating, and ultimately fail when the pressure rating is exceeded. This can allow pressures below the rating of the burst disk to be utilized for other operations. However, this solution again requires the burst pressure to be exceeded, meaning that there is no capability of using pressures above the pressure rating of the burst disk, without also causing this to rupture. Further, burst disks can lead to an immediate pressure/force impulse upon rupture, which could cause damage to actuated equipment. Also, conventional burst disks may introduce debris into the downhole equipment.

SUMMARY

An aspect of the present invention relates to a downhole pressure operated valve assembly, comprising:

an actuation fluid inlet for receiving an actuation fluid from a source;

an actuation fluid outlet for delivering the actuation fluid to a target;

a valve member moveable between a closed position in which the actuation fluid outlet is closed, and an open position in which the actuation fluid outlet is opened;

a locking arrangement for locking the valve member in its closed position; and a release member operable in response to a first predetermined fluid pressure event associated with at least the actuation fluid inlet to release the locking arrangement to permit the valve member to be moved to its open position in response to a second predetermined fluid pressure event associated with at least the actuation fluid inlet.

Accordingly, the valve assembly may be operated by application or the presence of predetermined pressure events associated with the actuation fluid inlet. By the application of the first and second predetermined pressure events the valve assembly may be configured from its closed position in which flow between the actuation fluid inlet and outlet is prevented, to its open position in which flow between the actuation fluid inlet and outlet is permitted.

Once the valve member is in its open position, the actuation fluid may be communicated with the target location, which may include any device or system which is operated by the actuation fluid. Some examples of such devices or systems include Inflow Control Devices (ICDs), valve sleeves, toe sleeves (such as the Zone Select toe sleeve sold by Weatherford), packers and/or packer actuators or the like. In some embodiments the valve assembly may be used in combination with or as part of a packer setting valve, such as the OptiSet packer setting valve sold by Weatherford.

In some embodiments, the pressure operated valve assembly may define a first pressure operated valve assembly. Once the valve member of the first valve assembly is in its open position, the actuation fluid may be communicated to a second pressure operated valve assembly. The first and second valve assemblies may be arranged in series. The second pressure operated valve assembly may be configured in substantially the same way as the first valve assembly. In such a case the outlet of the first valve assembly may be communicated to an inlet of the second valve assembly. Accordingly, this may permit a similar operation to be achieved with third and fourth pressure events to operate the second valve assembly. This arrangement may facilitate an increased level of operations to be achieved by a greater number of pressure events or sequences. Any suitable number of pressure operated valve assemblies may be operated in this series manner, with a final actuation fluid outlet eventually communicated to a desired target, such as a downhole tool.

In use, the present invention may permit the first pressure event to be applied without causing the valve member to open. In such an arrangement the first pressure event may be applied to provide operation of a further system, assembly or process, with minimal or reduced risk of prematurely opening the valve member. In some embodiments the first pressure event may facilitate other operations such as, for example, pressure testing, operation of other tools or equipment or the like.

At least one pressure event may be achieved by pressure directly applied, for example varied, at the fluid inlet.

Alternatively, or additionally, at least one pressure event may be achieved by application of a pressure differential with reference to the pressure at the fluid inlet. Such a pressure differential may be achieved by applying or varying the pressure at a remote location. In such an arrangement one or both of the release member and valve member may be in pressure communication with both the fluid inlet and the remote location such that operation of one or both members may be achieved by the pressure differential. The pressure differential may be achieved while the pressure at the fluid inlet is held substantially static. Accordingly, references herein to pressure applied, for example varied, at the fluid inlet should be understood to encompass a variation in a pressure differential with reference to the fluid inlet.

The first and second pressure events may be sequential. The second pressure event may be provided subsequent to the first pressure event. In some embodiments the first and second pressure events may overlap.

The first pressure event may comprise a pressure variation. The second pressure event may comprise a pressure variation. The second pressure event may comprise a predetermined pressure achieved during a variation in pressure of the first pressure event. For example, the second pressure event may be defined immediately by the pressure (or pressure differential) at the end of the first pressure event.

The first pressure event may include an increase in pressure at the actuation inlet. The first pressure event may include a decrease in pressure at the fluid inlet. The first pressure event may include a pressure cycle, comprising at least one period of increasing pressure and at least one period of decreasing pressure. The increasing and decreasing pressure periods may be arranged in any order. In one embodiment, the first pressure event may comprise a period of increasing pressure followed by a period of decreasing pressure.

As noted above, the second pressure event may be defined by a pressure achieved during the first pressure event.

The second pressure event may include an increase in pressure at the actuation inlet. Such an increase in pressure may be with reference to the pressure at the end of the first pressure event. The second pressure event may include a decrease in pressure at the fluid inlet. The second pressure event may include a pressure cycle, comprising at least one period of increasing pressure and at least one period of decreasing pressure, provided in any suitable sequence. In some embodiments the valve member may be moved or be permitted to be moved to its open position during or at the end of the second pressure event. The valve member may be moved or be permitted to be moved during an increasing pressure portion of a pressure cycle. The valve member may be moved or be permitted to be moved during a decreasing portion of a pressure cycle.

The release member may be operable to be moved from a locking position in which the locking arrangement is held locked. The release member may be moved from the locking position to a release position in response to the first pressure event, wherein when the release member is in its release position the locking arrangement is released.

The release member may be operable to be moved from the locking position to an intermediate position, prior to being moved to the release position, in response to the first pressure event, such as a pressure variation. The release member may retain the locking arrangement in a locked configuration when said release member is located in its intermediate position.

The release member may be moved from the locking position to the intermediate position, and subsequently from the intermediate position to the release position in response to a pressure cycle which defines the first pressure event. For example, the release member may be moved from the locking position to the intermediate position in response to a first period of the first pressure event, and moved from the intermediate position to the release position in response to a second period of the first pressure event.

In some embodiments the release member may be operable to move from the locking position to the intermediate position in response to a period of increasing or increased pressure, and subsequently moved from the intermediate position to the release position in response to a period of decreasing or decreased pressure. In such an arrangement the periods of increasing/increased and decreasing/decreased pressures may collectively define a pressure cycle of the first pressure event. Further, such an arrangement may permit the increasing/increased pressure to be utilized for other operations or functions (e.g., other tool actuation, pressure testing etc.), without the release member being moved to its release position.

In some embodiments the release member may be rotatably moveable.

In some embodiments the release member may be axially moveable. The release member may be defined by an axial piston member or structure. At least one portion of the release member may be in pressure communication with the fluid inlet. At least one portion of the release member may be in pressure communication with a remote location. In such an arrangement movement of the release member may be associated with a pressure differential applied between the fluid inlet and the remote location.

The release member may be moveable in a first direction, for example a rotary and/or axial direction, from its locking position to the intermediate position. Such movement may be achieved during at least a portion of the first pressure event, for example during a period of increasing or increased pressure.

The release member may be moveable over a first distance, for example a rotary and/or axial distance, between the locking position and the intermediate position.

The release member may be moveable in a second direction, for example a rotary and/or axial direction, from its intermediate position to its release position. The second direction may be opposite the first direction. Such movement may be achieved during at least a portion of the first pressure event, for example during a period of decreasing or decreased pressure.

The release member may be moveable over a second distance, for example a rotary and/or axial distance, between the intermediate position and the release position. In some embodiments the second distance may be larger than the first distance. The additional travel of the release member in the second direction may facilitate release of the locking arrangement.

The release member may comprise a latch arrangement configured to latch the release member in its release position. Such a latch arrangement may comprise a snap-ring arrangement or the like.

The locking arrangement may extend laterally between the valve member and the release member.

The locking arrangement may comprise at least one locking member which extends between the valve member and the release member.

The locking arrangement may engage a locking profile provided on the valve member to effectively lock the valve member in its closed position. The release member may rigidly support the locking arrangement to retain the locking arrangement in engagement with the locking profile of the valve member.

The release member may define a locking surface, wherein when the locking arrangement is aligned with the locking surface the locking arrangement is held in engagement with the locking profile of the release member. The locking surface may be defined by an area of increased diameter on the release member.

The release member may comprise a release surface, wherein when the release member is moved during the first pressure event the release surface becomes aligned with the locking arrangement, to permit movement of the locking member from the locking profile of the valve member. The release surface may be defined by an area of relief relative to the locking surface, to facilitate appropriate movement of the locking member. The release surface may be defined by a stepped region on the release member. The release surface may be defined by a recessed region on the release member. The release surface may be defined by a region of reduced diameter relative to the locking surface.

The locking arrangement may comprise a unitary member, such as a rod, ball or the like which extends between the release member and the valve member.

The locking arrangement may comprise a plurality of locking members extending between the release member and valve member. The locking members may extend or be arranged along a common axis. The common axis may extend substantially laterally between the valve member and the release member. The locking members may be stacked one against another.

The release member may be initially rigidly secured in its locking position by a releasable mechanism. The releasable mechanism may be defined by, for example, a shearing mechanism, such as by one or more shear screws. The releasable mechanism may permit release of the release member from its locking position upon application of a predetermined release force, for example applied by a pressure associated with the actuation fluid inlet. Such pressure may define part of the first pressure event.

The releasable mechanism may be released upon movement of the release member from its locking position to its intermediate position.

In some embodiments the release member may be resettable.

The valve assembly may comprise a sealing arrangement for providing sealing between the valve member and the fluid outlet when said valve member is in it closed position. The sealing arrangement may comprise one or more O-rings or the like which may be mounted on the valve member and/or in a bore surface in which the valve member is located. The sealing arrangement may comprise a pair of seal members, such as O-rings, which straddle the fluid outlet when the valve member is in its closed position.

The valve member may be rotatably moveable between its closed and open positions.

In some embodiments the valve member may be axially moveable. The valve member may be defined by an axial piston member or structure. At least one portion of the valve member may be in pressure communication with the fluid inlet. At least one portion of the valve member may be in pressure communication with a remote location. In such an arrangement movement of the valve member may be associated with a pressure differential applied between the fluid inlet and the remote location.

In one embodiment both the valve member and the release member may be axially moveable and arranged to move along respective first and second axes. The first and second axes may be coaxial. The first and second axes may be parallel, for example laterally offset and parallel. The first and second axes may be obliquely aligned relative to each other.

The valve member may be operable to be moved directly from its closed position to its open position in response to the second pressure event. For example, the valve member may be operable to be moved in a single direction from its closed position to its open position.

The valve member may be operable to be moved from its closed position to an intermediate position, prior to being moved to its open position. Such movement to the intermediate position may be in response to the second pressure event, such as a pressure variation. In some embodiments such movement of the valve member to the intermediate position may be in response to at least a portion of the first pressure event.

The fluid outlet may remain closed by the valve member when said valve member is located in its intermediate position.

The valve member may be moved from the closed position to the intermediate position, and subsequently from the intermediate position to the open position. Such movement of the valve member may be in response to the second pressure event. Such movement of the valve member may be achieved in response to a pressure cycle which defines the second pressure event. For example, the valve member may be moved from the closed position to the intermediate position in response to a first period of the second pressure event, and moved from the intermediate position to the open position in response to a second period of the second pressure event.

In some embodiments the valve member may be operable to move from the closed position to the intermediate position in response to a period of increasing or increased pressure, and subsequently moved from the intermediate position to the open position in response to a period of decreasing or decreased pressure. In such an arrangement the valve member may move from the intermediate position to the open position during a pressure bleed event. Periods of increasing/increased and decreasing/decreased pressures may collectively define a pressure cycle of the second pressure event. Further, such an arrangement may permit the increasing/increased pressure to be utilized for other operations or functions (e.g., other tool actuation, pressure testing etc.), without the fluid outlet being opened.

A sealing arrangement may maintain sealing of the fluid outlet when the valve member is in an intermediate position, such as the intermediate position described above. The sealing arrangement may comprise a pair of seal members, such as O-rings, which straddle the fluid outlet when the valve member is in its closed (and optionally intermediate) position.

The valve member may be moveable in a first direction, for example a rotary and/or axial direction, from its closed position to the intermediate position. Such movement may be achieved during at least a portion of the second pressure event, for example during a period of increasing or increased pressure. The valve assembly may comprise a movement limiter for limiting movement of the valve member in the first direction, such that movement of the valve member in the first direction beyond the intermediate position is prevented.

The valve member may be moveable over a first distance, for example a rotary and/or axial distance, between the closed position and the intermediate position.

The valve member may be moveable in a second direction, for example a rotary and/or axial direction, from its intermediate position to its open position. The second direction may be opposite the first direction. Such movement may be achieved during at least a portion of the second pressure event, for example during a period of decreasing or decreased pressure.

The valve member may be moveable over a second distance, for example a rotary and/or axial distance, between the intermediate position and the open position. In some embodiments the second distance may be larger than the first distance. The additional travel of the valve member in the second direction may facilitate opening of the fluid outlet.

The valve member may comprise a latch arrangement configured to latch the valve member in its open position. Such a latch arrangement may comprise a snap-ring arrangement or the like.

The valve member may be initially rigidly secured in its closed position by a releasable mechanism. The releasable mechanism may be defined by, for example, a shearing mechanism, such as by one or more shear screws. The releasable mechanism may permit release of the valve member from its closed position following release or unlocking of the locking arrangement, and upon subsequent application of a predetermined release force, for example applied by pressure associated with the actuation fluid inlet. As such, when the locking arrangement is in a locked configuration the releasable mechanism may be isolated from the effect of any pressure force associated with inlet pressure. The releasable mechanism may define or set a maximum pressure or pressure differential associated with the second pressure event.

The releasable mechanism may be released upon movement of the valve member from its closed position to its intermediate position.

The valve assembly may comprise a flow path extending between the actuation fluid inlet and outlet. The locking arrangement may be at least partially located with this flow path.

The valve assembly may comprise a housing. The housing may be defined by a unitary component which at least partially contains one or both of the valve member and the release member.

The housing may define one or both of the actuation fluid inlet and actuation fluid outlet.

The housing may comprise or be defined by multiple components secured together.

The valve assembly may be configured for mounting on or in a tubing string to be deployed within a wellbore, such as a cased or open hole wellbore. The tubing may define or form part of a completion tubing string, production tubing string, casing tubing string, workover string or the like.

In some embodiments the valve assembly may be mounted in a wall region of a tubing string, such as within a pocket formed within a wall region of a tubing string.

In some embodiments the valve assembly may be in pressure communication with one or both an internal region of a tubing string and an external region of a tubing string, such as an annulus region. In some embodiments such an arrangement may facilitate operation of the valve member by one or both of internal and external pressures.

The actuation fluid source may be provided downhole. The actuation fluid source may comprise fluid in a tubing in or on which tubing the valve assembly is mounted.

The actuation fluid may be isolated form fluids within the wellbore. Such an arrangement may minimize the risk of contamination of the valve assembly, for example by particulate matter or the like. The actuation fluid may be in pressure communication with a region of the wellbore, for example with an internal region of a tubing string in or on which the valve assembly is mounted. Such pressure communication may permit the wellbore pressure (for example internal tubing pressure) to vary to provide the pressure variations at the inlet.

The valve assembly may comprise a pressure transfer arrangement for facilitating transfer of pressure within a region of a wellbore and a source of actuation fluid. The pressure transfer arrangement may comprise a piston assembly, wherein one side of the piston assembly is exposed to a wellbore region (such as an internal volume of a tubing string), such that pressure within said wellbore region may be applied to the actuation fluid.

In some embodiments pressure within the region of the wellbore which is in pressure communication with the actuation fluid may function to drive the actuation fluid through the valve assembly from inlet to outlet when the valve member is open.

The valve member may be resettable.

The valve assembly may comprise a biasing arrangement associated with the release member. The biasing arrangement may function to bias the release member in one direction. The release member may be biased against movement by applied pressure at the inlet. This bias may function as a return force. Such a return force may be utilized to move the release member from its intermediate position to its release position, for example, The biasing arrangement may comprise a mechanical biasing arrangement, such as a spring or spring assembly.

The biasing arrangement may comprise a fluid biasing arrangement. The fluid biasing arrangement may function as a fluid spring. The fluid biasing arrangement may comprise a pressure arrangement for applying fluid pressure from a wellbore region, such as a wellbore annulus region. Such pressure may be applied directly or indirectly. The pressure arrangement may comprise a fluid port. The pressure arrangement may comprise a pressure transfer device. Such a pressure transfer device may isolate the valve assembly from direct contact with the wellbore fluids.

The fluid biasing arrangement may comprise a biasing fluid volume. Pressure within the biasing fluid volume may act to bias the release member in a preferred direction. Such pressure within the biasing fluid volume may be pre-set, for example set during manufacture or the like.

Pressure in the fluid volume may be increased during movement of the release member in one direction, for example the first direction mentioned above to move from the locking position to the intermediate position.

The volume may be expandable, for example elastically expandable, such that upon movement of the release member fluid may be transferred into the expandable volume. By virtue of the elastic expansion an effective increase in fluid pressure may be attained, acting to bias the release member against movement.

The expandable volume may be in pressure communication with a wellbore region, such as a wellbore annulus region. Accordingly, fluid pressure acting in the wellbore region may be effectively transferred to fluid within the expandable volume, and thus to the release member.

The expandable volume may comprise an elastic tube, such as a tube formed from a rubber, such as Viton.

The fluid biasing arrangement may comprise a compressible fluid, for example a compressible liquid, such as Silicon. Such compressibility may permit the release member to be moveable even when a non-expandable fluid volume is not present. Such an arrangement may minimize hydraulic lock within the valve assembly. In some embodiments the use of a compressible fluid may provide contingency in the event that an initially expandable volume is compromised, for example in the event of the expandable volume being encased in cement or the like.

The valve assembly may comprise a biasing arrangement associated with the valve member. The biasing arrangement may function to bias the valve member in one direction. The valve member may be biased against movement by applied pressure at the inlet. This bias may function as a return force. Such a return force may be utilized to urge the valve member to its closed position.

The biasing arrangement associated with the valve member may be substantially similar to a biasing arrangement associated with the release member as defined above.

In some embodiments a common biasing arrangement may be provided for both the release member and the valve member. For example, where a fluid biasing arrangement is provided, fluid pressure may be applied, for example simultaneously, to both the valve member and the release member.

In some embodiments the biasing arrangement may be configured to bias the valve member towards its closed position, such that fluid pressure needs to overcome the force of the bias to move the valve member towards its open position.

In some embodiments the biasing arrangement may be configured to bias the valve member towards its open position.

The biasing arrangement may comprise a mechanical biasing arrangement, such as a spring or spring assembly.

The biasing arrangement may comprise a fluid biasing arrangement. The fluid biasing arrangement may function as a fluid spring. The fluid biasing arrangement may comprise a pressure arrangement for applying fluid pressure from a wellbore region, such as a wellbore annulus region. Such pressure may be applied directly or indirectly. The pressure arrangement may comprise a fluid port. The pressure arrangement may comprise a pressure transfer device. Such a pressure transfer device may isolate the valve assembly from direct contact with the wellbore fluids.

The fluid biasing arrangement may comprise a biasing fluid volume. Pressure within the biasing fluid volume may act to bias the valve member in a preferred direction. Such pressure within the biasing fluid volume may be pre-set, for example set during manufacture or the like.

The biasing fluid volume may be in pressure communication with both the release member and the valve member.

Pressure in the fluid volume may be increased during movement of the valve member in one direction, for example the first direction mentioned above to move from the closed position to the intermediate position.

The volume may be expandable, for example elastically expandable, such that upon movement of the valve member fluid may be transferred into the expandable volume. By virtue of the elastic expansion an effective increase in fluid pressure may be attained, acting to bias the valve member against movement.

The expandable volume may be in pressure communication with a wellbore region, such as a wellbore annulus region. Accordingly, fluid pressure acting in the wellbore region may be effectively transferred to fluid within the expandable volume, and thus to the valve member.

The expandable volume may comprise an elastic tube, such as a tube formed from a rubber, such as Viton.

The fluid biasing arrangement may comprise a compressible fluid, for example a compressible liquid, such as Silicon. Such compressibility may permit the valve member to be moveable even when a non-expandable fluid volume is not present. Such an arrangement may minimize hydraulic lock within the valve assembly. In some embodiments the use of a compressible fluid may provide contingency in the event that an initially expandable volume is compromised, for example in the event of the expandable volume being encased in cement or the like.

In some embodiments opposing sides of the valve member may be exposed to a fluid biasing arrangement. A first side may define a first sealing area, and a second side may define a second sealing area. The first and second sealing areas may be different such that a bias effect in one direction may be achieved from the common fluid biasing arrangement. One side of the valve member may be directly exposed and thus in pressure communication with the fluid biasing arrangement. An opposite side of the valve member may be in pressure communication with the fluid biasing arrangement via a pressure port or conduit extending through, for example axially through, the valve member.

One of the first and second sealing areas may be defined by a sealing arrangement which functions to seal the fluid outlet when the valve member is in its closed position.

An intermediate region between the first and second sealing areas may be in pressure communication with the fluid inlet of the valve assembly. In such an arrangement inlet fluid pressure may be applied over one or both the first and second sealing areas.

An aspect of the present invention relates to a method for downhole actuation, comprising:

providing a valve member of a pressure operated valve assembly in a closed position in which an actuation fluid outlet is closed to prevent actuation fluid from reaching a target location;

locking the valve member in its closed position by use of a locking arrangement and a release member;

communicating fluid from a fluid source to an actuation fluid inlet of the pressure operated valve assembly;

establishing a first predetermined pressure event associated with at least the actuation fluid inlet to operate the release member to unlock the valve member; and establishing a second predetermined pressure event associated with at least the actuation fluid inlet to operate the valve member to move to an open position and permit actuation fluid to flow from the fluid source to the target location.

The downhole actuation method may be performed using the pressure operated valve assembly according to any other aspect. Accordingly, features of a valve system according to any other aspect may be applied to the current method for downhole actuation.

An aspect of the present invention relates to a valve assembly, comprising:

an actuation fluid inlet;

an actuation fluid outlet;

a valve member moveable between a closed position in which the actuation fluid outlet is closed, and an open position in which the actuation fluid outlet is opened; and a locking arrangement for locking the valve member in its closed position, wherein the locking arrangement is operable in response to a first predetermined fluid pressure event associated with at least the actuation fluid inlet to release the locking arrangement to permit the valve member to be moved to its open position in response to a second subsequent predetermined fluid pressure event associated with at least the actuation fluid inlet.

An aspect of the present invention relates to a downhole actuation system, comprising first and second valve assemblies each comprising:

an actuation fluid inlet;

an actuation fluid outlet;

a valve member moveable between a closed position in which the actuation fluid outlet is closed, and an open position in which the actuation fluid outlet is opened;

a locking arrangement for locking the valve member in its closed position; and a release member operable in response to a first predetermined fluid pressure event associated with at least the actuation fluid inlet to release the locking arrangement to permit the valve member to be moved to its open position in response to a second subsequent predetermined fluid pressure event associated with at least the actuation fluid inlet, wherein:

the actuation fluid inlet of the first valve assembly is in communication with an actuation fluid source;

the actuation fluid outlet of the first valve assembly is in communication with the actuation fluid inlet of the second valve assembly; and the actuation fluid outlet of the second valve assembly is in fluid communication with a target.

The downhole actuation system may comprise one or more pressure operated valve assemblies according to any other aspect.

An aspect of the present invention relates to a completion system for use within a wellbore, wherein the completion system comprises at least one pressure operated valve assembly according to any other aspect.

The completion system may comprise any suitable tool or system which may be coupled to at least one pressure operated valve assembly to facilitate delivery of actuation fluid for operation of the tool or system.

The tool or system may include any device or system which is operable by the actuation fluid. Some examples of such devices or systems include Inflow Control Devices (ICDs), valve sleeves, toe sleeves (such as the Zone Select toe sleeve sold by Weatherford), packers and/or packer actuators or the like. In some embodiments the completion system may comprise a packer setting valve, such as the OptiSet packer setting valve sold by Weatherford.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1A:
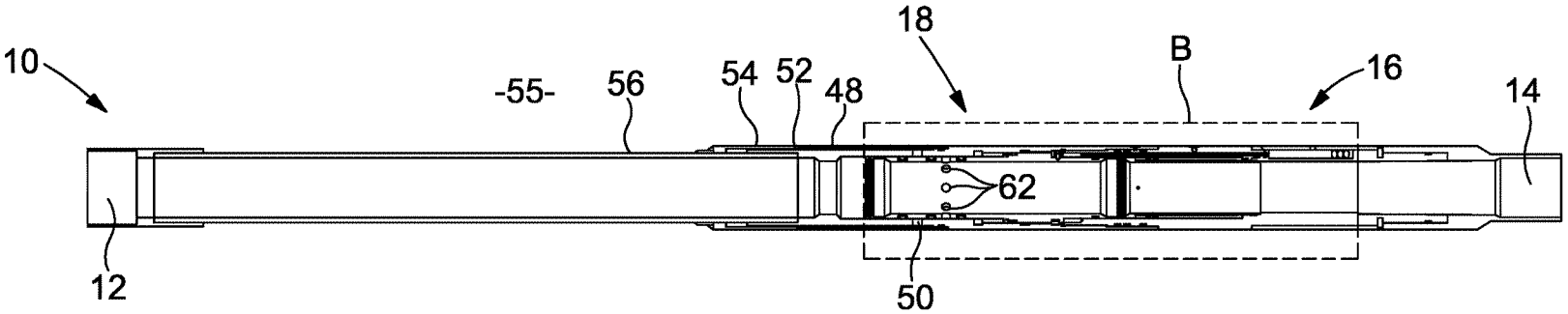
FIG. 1A is a diagrammatic illustration of a completion system which includes a pressure operated valve assembly according to an embodiment of the present invention, wherein the completion system includes an ICD in a closed configuration.

There are limitations with Composite resins, both with temperature and triaxial loading. Industry is directing the use of composites in higher temperature applications, in addition to requiring higher load capabilities. Current technology cannot meet these requirements. Historically composite technology has advanced by higher temperature resins reinforced with carbon and glass fibers at a macro level. This is industry standard.

FIG. 1 is a diagrammatic illustration of a completion system, generally identified by reference numeral 10, in accordance with an embodiment of the present invention. The completion system 10 includes threaded connectors 12, 14 at opposing ends thereof to facilitate securing in-line with a completion string (not shown).

The completion system 10 includes a pressure operated valve assembly, generally identified by reference numeral 16, and a downhole tool 18 which is to be actuated by the valve assembly 16. In the present illustrated embodiment the downhole tool is an ICD, although any other fluid actuated tool or system may be used.

Figure 1B:
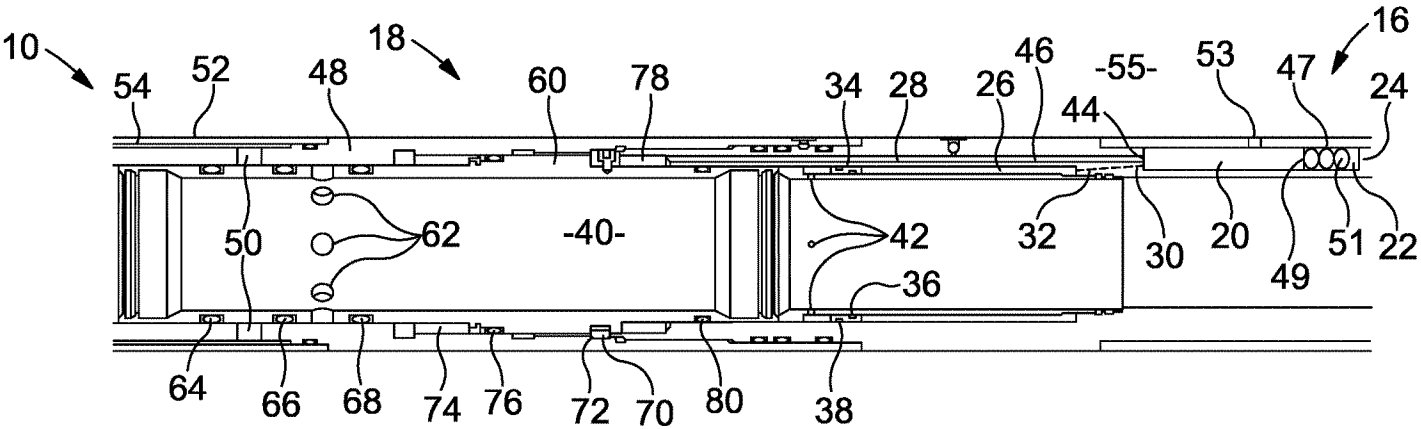
FIG. 1B is an enlarged view of the region B in FIG. 1A.

An enlarged view of the completion system 10 in the region B of FIG. 1A is provided in FIG. 1B, reference to which is now made. The valve assembly 16 includes a valve housing 20 located within a pocket 22 formed in a wall 24 of the completion system 10.

A reservoir of actuation fluid 26 is provided within an annular space 28 within the wall 24 of the completion system 10, wherein the actuation fluid 26 is in communication with the valve housing 22 via an actuation fluid inlet 30, with the communication path illustrated by broken line 32.

A pressure transfer arrangement in the form of an annular piston 34 is positioned within the annular space 28, sealed against the inner and outer walls of the annular space 28 by respective inner and outer seals 36, 38. The annular piston 34 is arranged such that one side thereof is in communication with the actuation fluid 26, and an opposing side is in communication with fluid within the bore 40 of the completion system 10 via ports 42. Accordingly, the pressure of the actuation fluid 26, and thus the pressure acting at the fluid inlet 30 of the valve housing 20, may be substantially equalised with the internal pressure of the completion system 10. The provision of the annular piston 34 provides the ability to impart the completion pressure into the actuation fluid 26, while minimising the risk of fluid contamination, which may otherwise compromise the valve assembly 16.

The valve housing 20 includes or defines an actuation fluid outlet 44 which is in fluid communication with the ICD 18 via flow path 46. As will be described in more detail below, the valve assembly 16 functions to selectively deliver the actuation fluid 26 to the ICD 18 via the flow path 46 to facilitate operation or actuation of the ICD 18.

An elastic tube 47, such as may be formed from Viton, is in fluid communication with a reference port 49 of the valve housing 20, wherein the elastic tube 47 is coiled or laid in a serpentine form within the pocket 22. In the embodiment shown the tube 47 is filled with a compressible fluid 51, such as Silicon oil. The pocket 22 is in communication with the space 55 external of the completion system 10 (which may be an annulus space) via a port 53, such that external pressure may act on the outer surface of the tube 47, and thus impart this pressure to the compressible fluid 51. As will be described in more detail below, the elastic tube 47 and compressible fluid 51 function as a biasing arrangement within the valve assembly 16.

The ICD 18 includes a housing 48 which includes a number of circumferentially arranged ports 50. An outer shroud 52 surrounds the ports 50, wherein the shroud 52 defines an annular flow path 54 with the housing 48. A screen material 56 (see FIG. 1A) closes an end of the annular flow-path 54 such that inflow from the space 55 surrounding the completion system (the wellbore annulus) is permitted through the screen material 56, which functions as a filter.

The ICD 18 further includes a sleeve 60 mounted internally of the housing 48, wherein the sleeve 60 includes a plurality of circumferentially arranged ports 62. In the configuration shown in FIG. 1B the sleeve 60 is in a closed position, such that the ports 62 of the sleeve 60 are misaligned from the ports 50 in the housing 48, preventing inflow. A number of O-ring seals 64, 66, 68 are axially placed along the outer surface of the sleeve 60, and when in the closed position seals 64 and 66 straddle the ports 50 to provide sealing of said ports 50. The sleeve 60 is held within this closed position by a beveled-edge snap ring 70 secured to the sleeve 60 and received within an annular recess 72 formed in the inner surface of the housing 48.

A first chamber 74 is defined between the sleeve 60 and the housing 48, wherein said first chamber 74 is provided at atmospheric pressure. O-ring seal 68 cooperates with a further seal 76 to isolate the first chamber 74.

A second chamber 78 is defined between the sleeve 60 and the housing 48 (and other wall sections of the completion system 10). The second chamber 78 is isolated via the seal 76 and a further seal 80. The flow path 46 from the fluid outlet 44 of the valve housing 20 is in communication with the second chamber 78.

As will be described in more detail below, in use, fluid pressure within the bore 40 of the completion system 10 may be varied to eventually establish communication of the actuation fluid 26, through the valve housing 20, along the flow-path 46 and into the second chamber 78. When the pressure force is sufficient the snap ring 70 will be disengaged to allow the sleeve 60 to move to open the ports 50 in the housing.

Figure 2A:
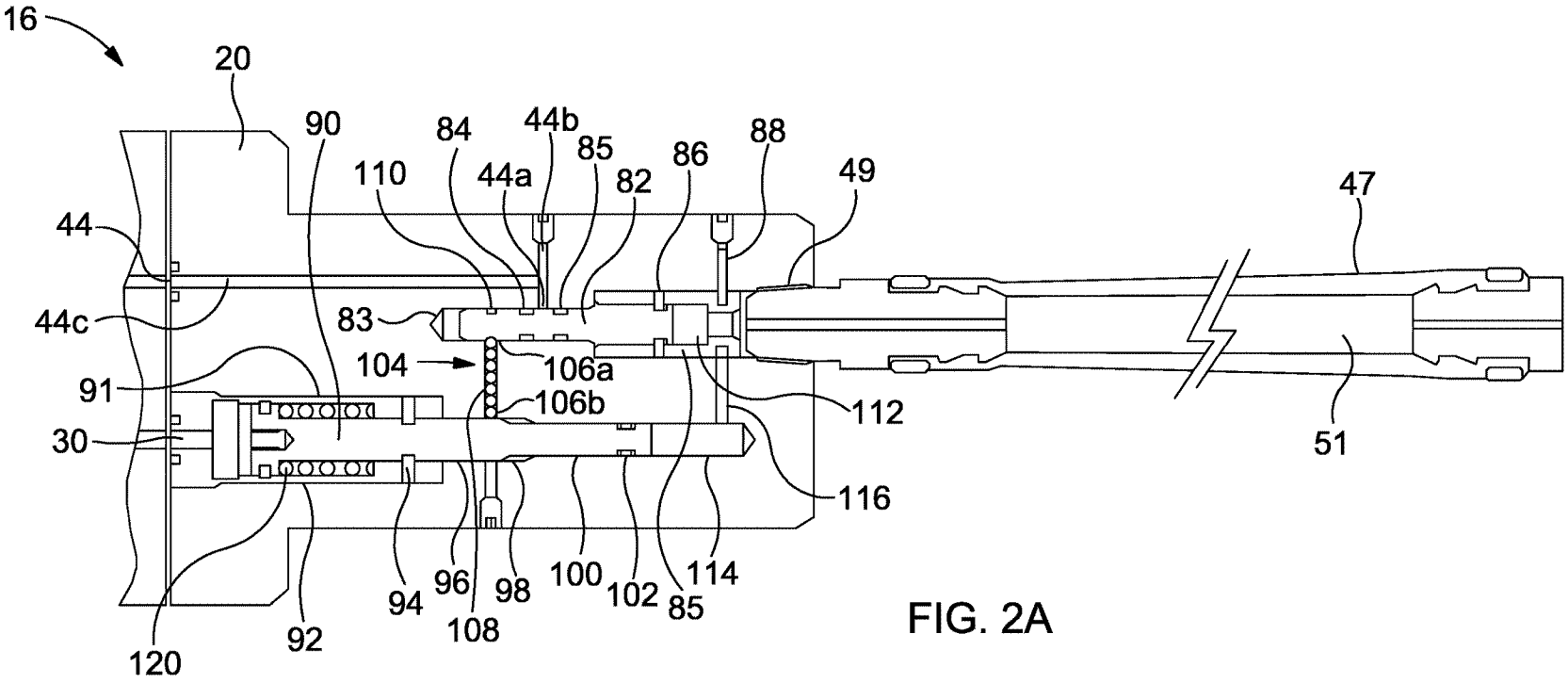
FIGS. 2A to 2D are diagrammatic sequential illustrations of the use of a pressure operated valve assembly in accordance with an embodiment of the present invention.

FIG. 2A is a diagrammatic cross-sectional illustration of the valve housing 20 of the valve assembly 16 of FIG. 1B. The valve assembly includes a valve member 82 in the form of an axially moveable piston mounted within a first stepped bore 83 within the housing 20. The valve member 82 is shown in FIG. 2A in a position in which the fluid outlet 44 is closed. Specifically, the valve member 82 carries a pair of O-rings 84, 85 which, when the valve member 82 is in the configuration of FIG. 2A, engage the housing 20 and straddle and seal a port 44*a*, which port 44*a* is in fluid communication with the outlet port 44 via drilled bores 44*b*, 44*c*.

The valve member 82 is shown in FIG. 2A initially secured to a fixture sleeve 85 via shear pins 86, wherein the fixture sleeve 85 is rigidly secured to the housing 20 via a connecting pin 88. The fixture sleeve 85 provides advantages in terms of manufacture. However, in other embodiments the valve member 82 may be directly secured to the housing 20 via shear pins.

The valve assembly 16 further includes a release member 90 in the form of an axially moveable piston which is located within a second stepped bore 91, wherein the release member 90 is shown in FIG. 2A initially secured to a fixture sleeve 92 via shear pins 94, wherein the fixture sleeve 92 is rigidly fixed to the housing 20. This initial position of the release member 90 may be defined as a locking position.

The release member 90 includes a large diameter region 96 which merges, via a ramped step 98, with a reduced diameter region 100. An O-ring seal 102 is provided on the reduced diameter region 100 and establishes a seal between the release member 90 and the housing 20.

One side of the release member 90 is in fluid communication with the fluid inlet 30, wherein the actuation fluid 26 (FIG. 1B) provided via the fluid inlet 30 acts against the release member 90 over the area defined by the O-ring seal 102.

The valve assembly 16 includes a locking arrangement 104 in the form of a plurality of stacked balls 106 which are located in a drilled bore 108 extending between the respective bores 83, 91, wherein the drilled bore 108 also provides fluid communication between said bores 83, 91. The uppermost ball 106*a* (relative to the orientation of the Figure) is located within a locking recess 110 formed in the valve member 82, whereas the lowermost ball 106*b* (relative to the orientation of the Figure) is engaged by the large diameter region 96 of the release member 90. Thus, in the arrangement shown in FIG. 2A the locking arrangement 104 functions to lock the valve member 82 in the illustrated closed position.

Both the valve member 82 and the release member 90 are in fluid communication with the elastic tube 47 and the compressible fluid 51 via the reference port 49. In particular a first reference chamber 112 is defined by the valve member 82 and the first bore 83, wherein the first reference chamber 112 is in communication with the reference port 49. The O-ring 85 isolates the first reference chamber 112 from the outlet port 44, such that fluid pressure acting at the reference port 49 acts on the valve member 82 over the area defined by seal 85.

A second reference chamber 114 is defined by the release member 90 and the second bore 91, wherein the first and second reference chambers 112, 114 are in fluid communication via a connecting bore 116. The O-ring 102 provided on the release member 90 isolates the second reference chamber 114 from the inlet port 30, such that fluid pressure at the reference port 49 acts on the release member 90 over the area defined by the seal 102.

When in the initial position shown in FIG. 2A, as noted above, the valve member 83 is in a closed position in which the outlet fluid port 44 is isolated from the inlet fluid port 30. Further, the release member 90 is in a locked position which rigidly secures the locking arrangement 104 to lock the valve member 82 in its closed position.

Figure 2B:
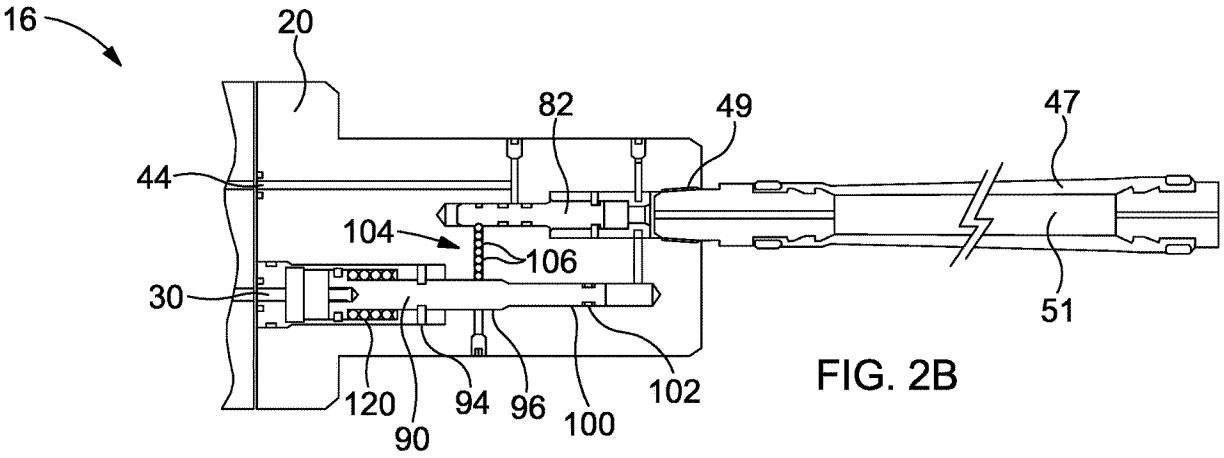

In the present embodiment operation of the valve assembly 16 is achieved by sequential pressure events associated with the fluid inlet 30. In this respect pressure at the inlet 30 is initially increased by increasing the pressure within the bore 40 (FIG. 1B) of the completion system 10. When an appropriate pressure is exceeded the shear pins 94 initially holding the release member 90 in place are sheared and the release member 90 is displaced axially in a first direction to an intermediate position, as shown in FIG. 2B. This axial displacement is resisted by the fluid 51 within tube 47, in addition to an optional spring 120. At this intermediate position the balls 106 of the locking arrangement 104 are still supported by the larger diameter region 96 of the release member 90 such that the valve member 82 remains locked.

Figure 2C:
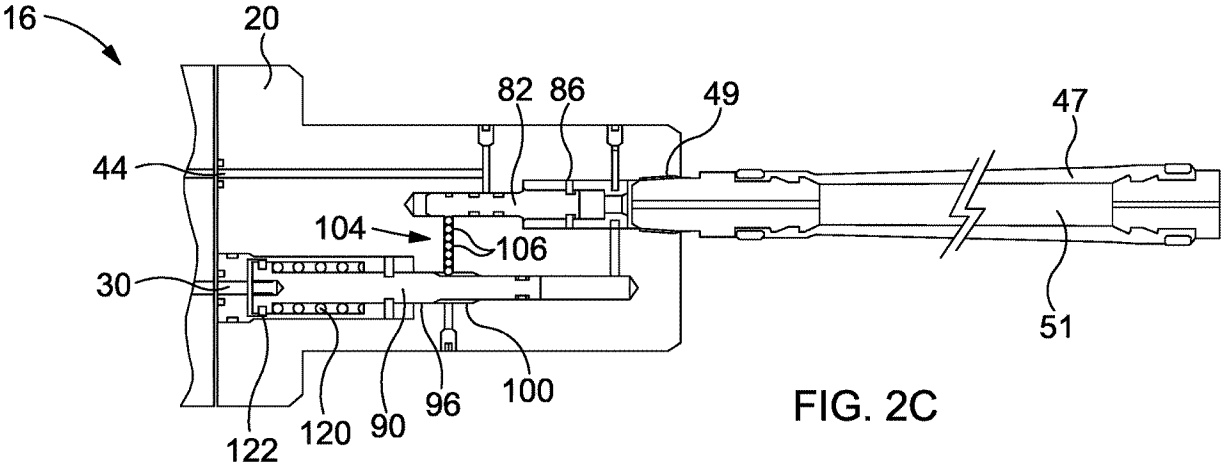

Subsequent to this, as illustrated in FIG. 2C, pressure at the inlet 30 is reduced, such that the release member 90 is displaced in a second or return direction by the action of the fluid 51 in combination with the spring 120. When the release member 90 is fully displaced in the second direction, which may be defined as a release position, a snap ring 122 secures the release member 90 in place.

The release member 90 is permitted to travel a greater distance in the second direction such that the balls 106 of the locking arrangement 104 become aligned with the reduced diameter region 100 of the release member 90 when the release member 90 is located in its release position, allowing the valve member 82 to become unlocked, but still retained in its closed position by its shear screws 86. In such an arrangement, although a pressure event has occurred, the valve member 82 nevertheless remains closed. Accordingly, the pressure during the first pressure event may be utilised for another task or operation, without inadvertently causing the valve member 82 to open. Such other task or operation may include actuation of other tools or systems within a completion string, pressure testing within the completion string or surrounding annulus or the like.

In the present embodiment the pressure cycle of increasing and subsequently decreasing pressure at the inlet 30 may be considered to be a first pressure event. Further, although the release member 90 is described as being moved by increasing/decreasing pressure at the inlet 30, the same effect may be achieved by alternatively or additionally decreasing/increasing pressure of the fluid 51 within tube 47 to provide a variation in differential pressure applied across the release member 90. Such pressure variation in the tube 47 may be achieved by varying the pressure in the external space 55 (e.g., wellbore annulus).

Figure 2D:
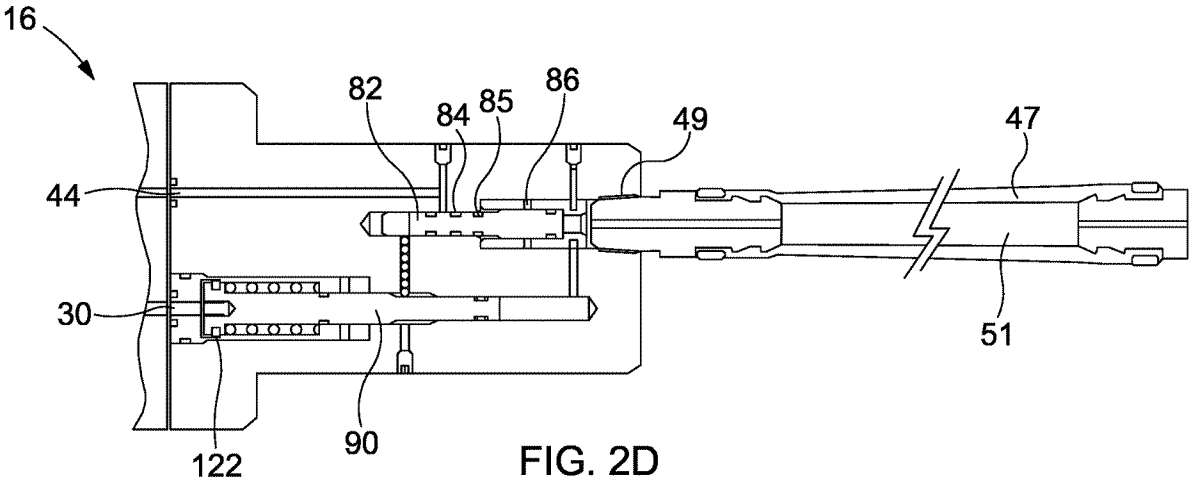

Once the valve member 82 is unlocked, as described above, a second pressure event may be applied at the inlet 30. In the present embodiment this second pressure event is achieved by again increasing the pressure at the inlet (and/or decreasing the pressure of the fluid 51 within the tube 47). When a defined pressure differential across the valve member (specifically across the seals 84, 85) is achieved the shear screws 86 of the valve member 82 are sheared, permitting the valve member 82 to be moved under the action of the pressure differential to its open position, as illustrated in FIG. 2D, establishing fluid communication of the actuation fluid 26 (FIG. 1B) from the fluid inlet 30 to the fluid outlet.

Figure 3:
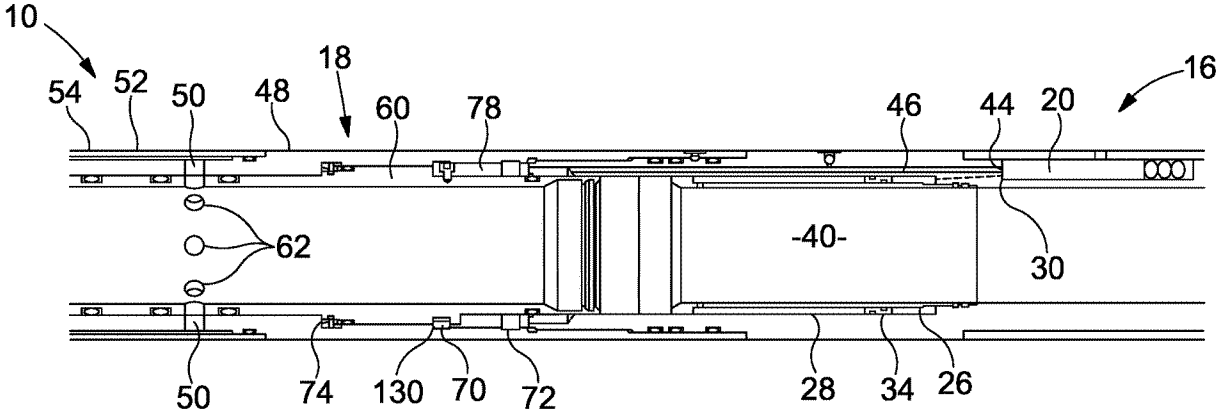
FIG. 3 illustrates the ICD of FIG. 1A in an open position.

As illustrated in FIG. 3, this actuation fluid 26 is delivered from the valve outlet 44, via the flow path 46 into the second chamber 78 defined between the sleeve 60 and the wall structure of the completion system 10. When sufficient pressure is achieved the beveled snap ring 70 is disengaged from recess 72 and the sleeve 60 is moved to an open position in which the ports 62 of the sleeve 60 become aligned with the ports 50 in the housing 48, opening the ICD 18. The snap ring 70 engages a second recess 130 to assist to hold the sleeve 60 in this open position.

It should be noted that in some cases the completion system 10 may be cemented within a wellbore. In such a case the effect of any pressure external of the completion system 10 may not act or sufficiently act on the fluid 51 within the tube 47. In such a case the tube 47 may effectively act like a rigid structure. However, as contingency for this to prevent hydraulic lock, the fluid 51 is selected to be compressible, such that movement of the valve member 82 and release member 90 may still be permitted. In fact, in some embodiments the tube 47 may be provided as a rigid member.

The valve housing 20 may be provided in a compact manner. In some instances more than one valve housing 20 may be provided, connected in series, as illustrated in FIG. 4, which illustrates a first valve housing 20*a* and a second valve housing 20*b*, wherein each housing 20*a*, 20*b* is configured in the same manner as housing 20 first shown in FIG. 2A, and as such no further description will be given.

The inlet 30*a* of the first housing 20*a* is in communication with an actuation fluid 26. The outlet 44*a* of the first housing 20*a* is in fluid communication with the inlet 30*b* of the second housing 20*b*. The outlet 44*b* of the second housing 20*b* is in fluid communication with a target (which may be the ICD 18 described above, or any other tool or system).

Figure 4A:
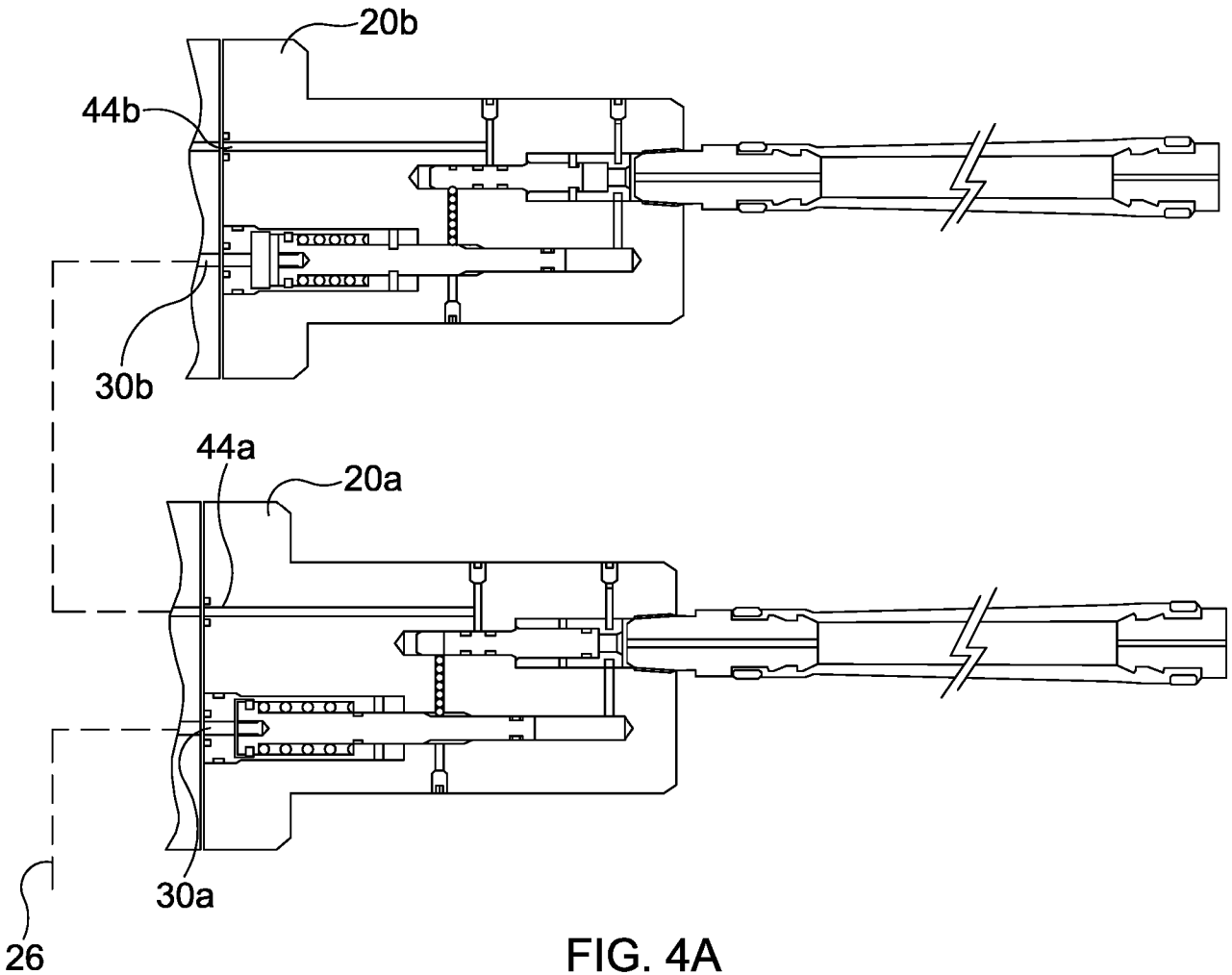
FIGS. 4A and 4B are sequential diagrammatic illustrations of a downhole actuation system in accordance with an embodiment of the present invention.
Figure 4B:
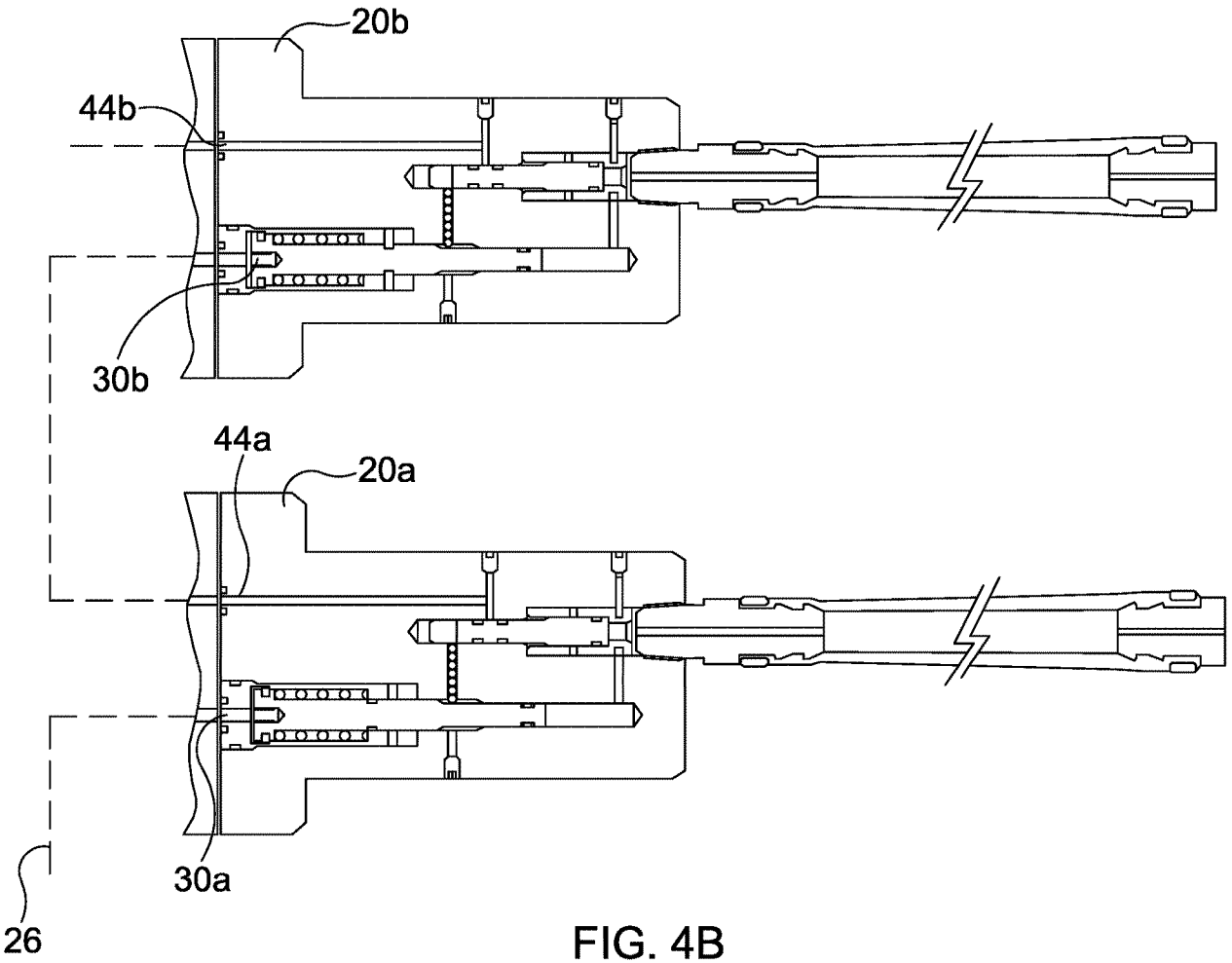

In FIG. 4A the first valve housing 20*a* is shown in an open configuration, achieved by application of two pressure events, as described above in relation to valve housing 20. As such, the actuation fluid may be delivered to and act at the inlet 30*b* of the second housing 20*b*. Application of a further two pressure events associated with the actuation fluid may cause the second valve housing 20*b* to become opened, as illustrated in FIG. 4B, permitting the actuation fluid to be delivered to the target location. Of course, any suitable number of valve housings may be utilised, permitting a greater number of pressure events to be applied prior to final delivery of the actuation fluid to a tool or system for operation thereof.

Figure 5A:
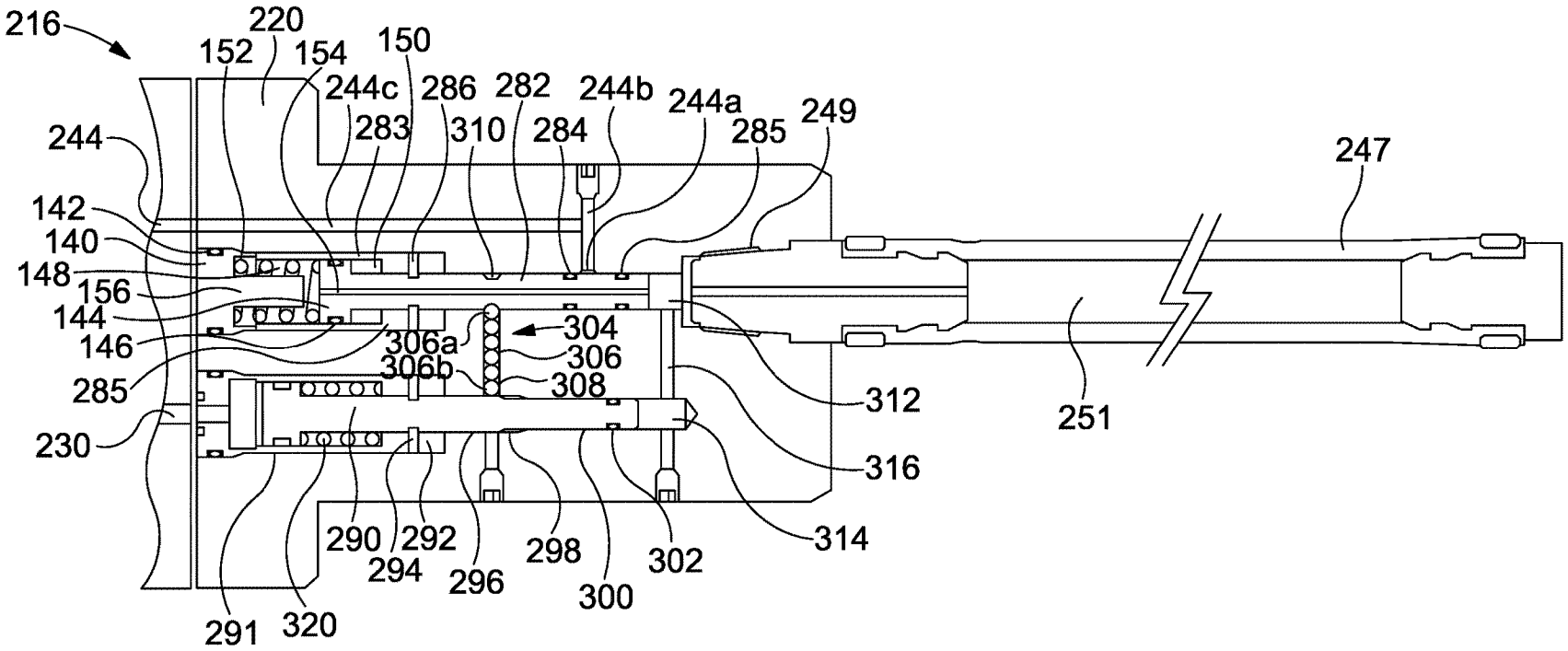
FIGS. 5A to 5E are sequential diagrammatic illustrations of the use of a pressure operated valve assembly in accordance with an alternative embodiment of the present invention.

An alternative embodiment of a valve assembly 216 is illustrated in FIG. 5A, wherein the valve assembly 216 may be used in the completion system 10 of FIG. 1 (or any other completion system). The valve assembly 216 is similar to valve assembly 16 described above and as such like features share like reference numerals, incremented by 200.

The valve assembly 216 includes a housing 220 which includes or defines an inlet port 230, for example to communicate with the source of actuation fluid 26 of the system 10 FIG. 1B, and an outlet port 244, for example to communicate with the flow path 46 of the system 10 in FIG. 1A. The housing 220 further defines a reference port 249 for facilitating communication with a fluid 251 within an elastic tube 247.

The valve assembly 216 includes a valve member 282 in the form of an axially moveable piston mounted within a first stepped bore 283 within the housing 220. The valve member 282 is shown in FIG. 5A in a position in which the fluid outlet 244 is closed. Specifically, the valve member 282 carries a pair of O-rings 284, 285 which, when the valve member 282 is in the configuration of FIG. 5A, engage the housing 220 and straddle and seal a port 244*a*, which port 244*a* is in fluid communication with the outlet port 244 via drilled bores 244*b*, 244*c*.

The valve member 282 is shown in FIG. 5A initially secured to a fixture sleeve 285 via shear pins 286, wherein the fixture sleeve 285 is held stationary (at least in an axial direction) relative to the housing 220 via a clamping member 140, wherein the clamping member 140 is sealed relative to the housing 220 via an O-ring 142. In other embodiments the valve member 282 may be directly secured to the housing 220 via shear pins.

The valve member includes a piston head 144 which is located within the fixture sleeve 285, with a piston seal 146 provided between the piston head 144 and the fixture sleeve 285. Such an arrangement establishes a piston chamber 148 on one side of the valve member 282, and an intermediate chamber 150 which is defined between the O-ring seal 284 and the piston seal 146. A spring member 152 is located within the piston chamber 148 and acts between the clamping member 140 and the piston head 144.

The valve assembly 216 further includes a release member 290 in the form of an axially moveable piston which is located within a second stepped bore 291, wherein the release member 290 is shown in FIG. 5A initially secured to a fixture sleeve 292 via shear pins 294, wherein the fixture sleeve 292 is rigidly fixed to the housing 220. This initial position of the release member 290 may be defined as a locking position.

The release member 290 includes a large diameter region 296 which merges, via a ramped step 298, with a reduced diameter region 300. An O-ring seal 302 is provided on the reduced diameter region 300 and establishes a seal between the release member 290 and the housing 220.

One side of the release member 290 is in fluid communication with the fluid inlet 230, wherein the actuation fluid 26 (FIG. 1B) provided via the fluid inlet 230 acts against the release member 290 over the area defined by the O-ring seal 302.

The valve assembly 216 includes a locking arrangement 304 in the form of a plurality of stacked balls 306 which are located in a drilled bore 308 extending between the respective bores 283, 291, wherein the drilled bore 308 also provides fluid communication between said bores 283, 291. More particularly, the drilled bore 308 communicates with the intermediate chamber 150 formed in the first bore 283 by the valve member 282 and seals 284, 146. As such, fluid received at the inlet 230 may be communicated with this intermediate chamber 150.

The uppermost ball 306*a* (relative to the orientation of the Figure) is located within a locking recess 310 formed in the valve member 282, whereas the lowermost ball 306*b* (relative to the orientation of the Figure) is engaged by the large diameter region 296 of the release member 290. Thus, in the arrangement shown in FIG. 5A the locking arrangement 304 functions to lock the valve member 282 in the illustrated closed position.

Both the valve member 282 and the release member 290 are in fluid communication with the elastic tube 247 and the compressible fluid 251 via the reference port 249. In particular a first reference chamber 312 is defined by the valve member 282 and the first bore 283, wherein the first reference chamber 312 is in communication with the reference port 249. The O-ring 285 isolates the first reference chamber 312 from the outlet port 244, such that fluid pressure acting at the reference port 249 acts on the valve member 282 in a first direction over the area defined by seal 285. Further, a throughbore 154 extends axially through the valve member 282 such that fluid communication is provided between the first reference chamber 312 and the piston chamber 148. This arrangement permits fluid pressure acting at the reference port 249 to also act on the valve member 282 in a second, opposite direction over the area defined by the piston seal 146. In this respect the piston seal 146 defines a larger area than the O-ring seal 285, such that a larger force will be generated on the valve member in the second direction.

A second reference chamber 314 is defined by the release member 290 and the second bore 291, wherein the first and second reference chambers 312, 314 are in fluid communication via a connecting bore 316. The O-ring 302 provided on the release member 290 isolates the second reference chamber 314 from the inlet port 230, such that fluid pressure at the reference port 249 acts on the release member 290 over the area defined by the seal 302.

When in the initial position shown in FIG. 5A, as noted above, the valve member 283 is in a closed position in which the outlet fluid port 244 is isolated from the inlet fluid port 230. Further, the release member 290 is in a locked position which rigidly secures the locking arrangement 304 to lock the valve member 282 in its closed position.

Figure 5B:
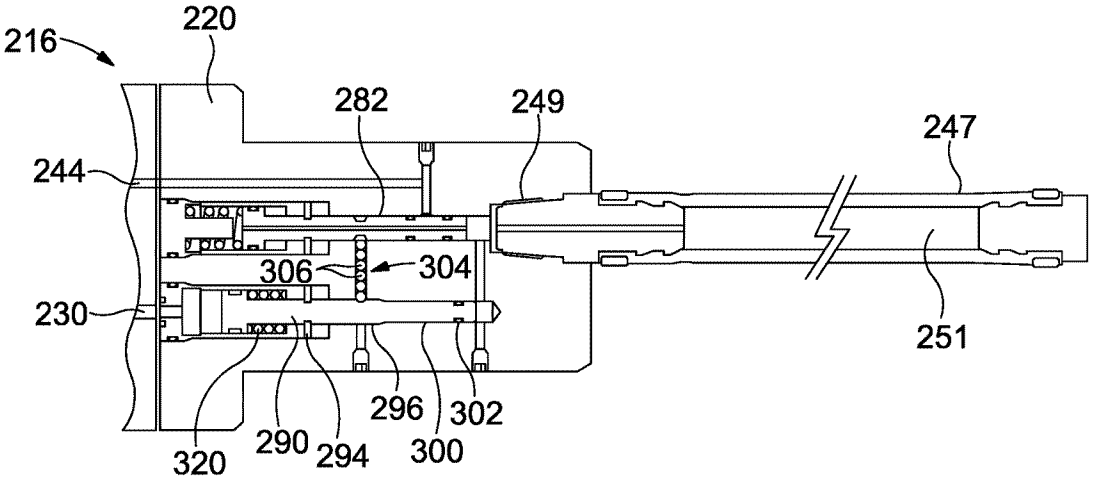

In the present embodiment operation of the valve assembly 216 is achieved by sequential pressure events associated with the fluid inlet 230. In this respect pressure at the inlet 230 is initially increased by increasing the pressure within the bore 40 (FIG. 1B) of the completion system 10. When an appropriate pressure is exceeded the shear pins 294 initially holding the release member 290 in place are sheared and the release member 290 is displaced axially in a first direction to an intermediate position, as shown in FIG. 5B. This axial displacement is resisted by the fluid 251 within tube 247, in addition to an optional spring 320. At this intermediate position the balls 306 of the locking arrangement 304 are still supported by the larger diameter region 296 of the release member 290 such that the valve member 282 remains locked.

Figure 5C:
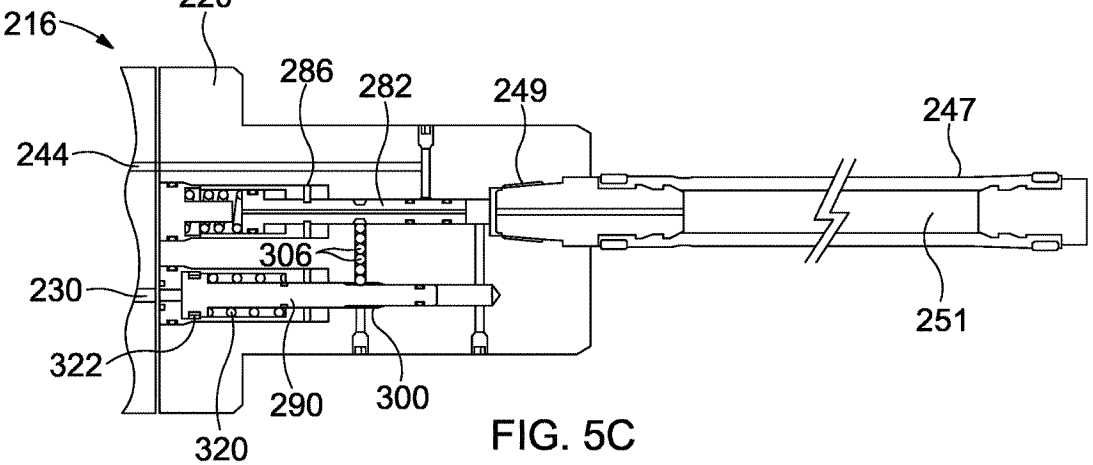

Subsequent to this, as illustrated in FIG. 5C, pressure at the inlet 230 is reduced, such that the release member 290 is displaced in a second or return direction by the action of the fluid 251 in combination with the spring 320. When the release member 290 is fully displaced in the second direction, which may be defined as a release position, a snap ring 322 secures the release member 290 in place.

The release member 290 is permitted to travel a greater distance in the second direction such that the balls 306 of the locking arrangement 304 become aligned with the reduced diameter region 300 of the release member 290 when the release member 290 is located in its release position, allowing the valve member 282 to become unlocked, but still retained in its closed position by its shear screws 286. In such an arrangement, although a pressure event has occurred, the valve member 282 nevertheless remains closed. Accordingly, the pressure during the first pressure event may be utilised for another task or operation, without inadvertently causing the valve member 282 to open. Such other task or operation may include actuation of other tools or systems within a completion string, pressure testing within the completion string or surrounding annulus or the like.

In the present embodiment the pressure cycle of increasing and subsequently decreasing pressure at the inlet 230 may be considered to be a first pressure event. Further, although the release member 290 is described as being moved by increasing/decreasing pressure at the inlet 230, the same effect may be achieved by alternatively or additionally decreasing/increasing pressure of the fluid 251 within tube 247 to provide a variation in differential pressure applied across the release member 290. Such pressure variation in the tube 247 may be achieved by varying the pressure in the external space 55 (e.g., wellbore annulus).

Figure 5D:
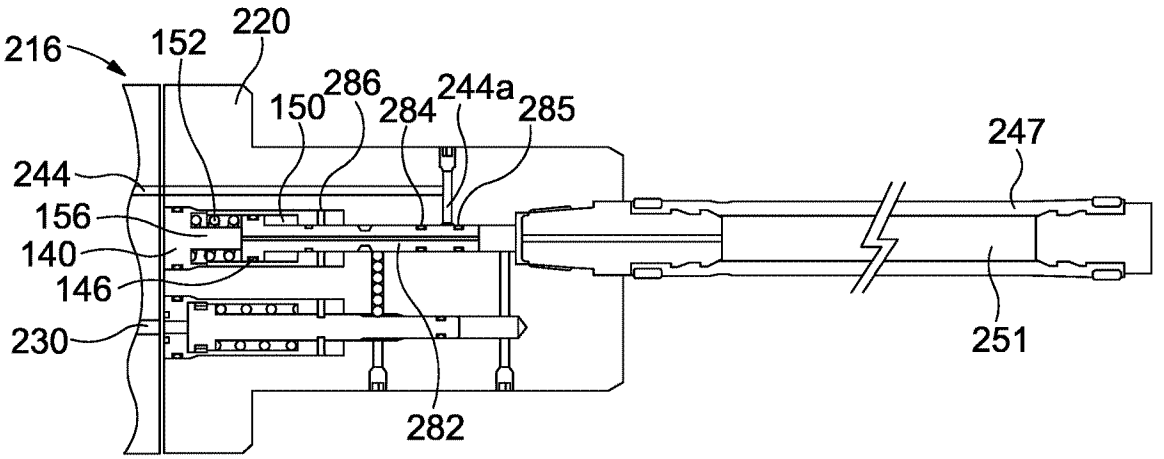

Once the valve member 282 is unlocked, as described above, a second pressure event may be applied at the inlet 230. In the present embodiment this second pressure event is achieved by again increasing the pressure at the inlet 230 (and/or decreasing the pressure of the fluid 251 within the tube 247). Such inlet pressure is communicated to the intermediate chamber 150, held between seals 284, 146. As the sealing area of seal 146 is larger than that of seal 284, a net force will be established in a first direction, and when this net force reaches a predefined magnitude (taking into account the resistance force generated by the pressure of the fluid 251 and the spring 152) the shear screws 286 of the valve member 282 are sheared, permitting the valve member 282 to be moved under the action of the net force in the first direction towards an intermediate position, as illustrated in FIG. 5D. Movement of the valve member 282 is halted at the intermediate position by a movement limiter in to form of a stem 156 extending from the clamping member 140. When in this intermediate position the O-ring seals 284, 285 still straddle the port 244*a*, thus maintaining the fluid outlet 244 closed.

Figure 5E:
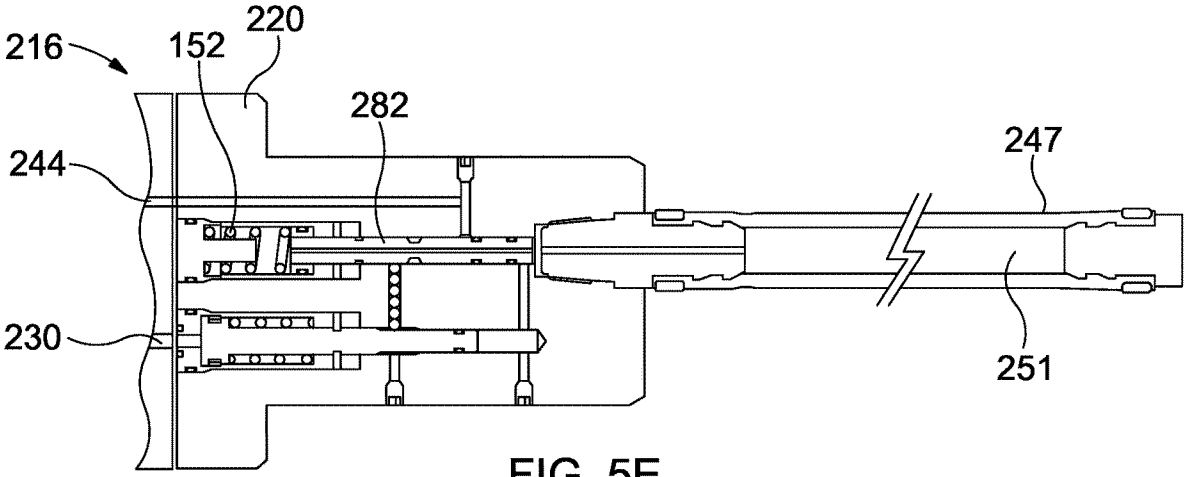

Subsequent to this, pressure at the inlet 230 may be reduced (and/or the pressure of the fluid 251 may be increased), with such pressure variation forming part of the second pressure event. This pressure variation may result in the valve member 282 being moved in a second or reverse direction by the force dominance of the spring 152 and fluid pressure 251 to eventually position the valve member 282 in its open position, as illustrated in FIG. 5E, establishing fluid communication of the actuation fluid 26 (FIG. 1B) from the fluid inlet 230 to the fluid outlet 244. As such, final opening of the valve member 282 may be achieved during a pressure bleed-down event.

It should be noted that the valve assembly 216 may also be arranged in a series manner.

It should be understood that the embodiments described herein are merely exemplary and that various modifications may be made thereto without departing from the scope of the invention.

The invention claimed is:

1. A downhole pressure operated valve assembly, comprising:

an actuation fluid inlet for receiving an actuation fluid from a source;

an actuation fluid outlet for delivering the actuation fluid to a target;

a valve member moveable between a closed position in which the actuation fluid outlet is closed, and an open position in which the actuation fluid outlet is opened;

a locking arrangement for locking the valve member in the closed position; and a release member operable in response to a first predetermined fluid pressure event associated with at least the actuation fluid inlet to release the locking arrangement to permit the valve member to be moved to the open position in response to a second predetermined fluid pressure event associated with at least the actuation fluid inlet, wherein the release member is operable to be moved in response to the first pressure event from a locking position in which the locking arrangement is held locked to a release position in which the locking arrangement is released, wherein the release member is operable to be moved in response to the first pressure event from the locking position to a first intermediate position prior to being moved to the release position, wherein the release member is operable to retain the locking arrangement in a locked configuration when said release member is located in the first intermediate position, and wherein the release member is operable to move from the locking position to the first intermediate position in response to a period of increasing or increased pressure, and subsequently to be moved from the first intermediate position to the release position in response to a period of decreasing or decreased pressure.

2. The downhole pressure operated valve assembly according to claim 1, wherein the release member is defined by an axial piston member or structure, wherein at least one portion of the release member is in pressure communication with the actuation fluid inlet, and wherein at least one portion of the release member is in pressure communication with a remote location such that movement of the release member is associated with a pressure differential applied between the actuation fluid inlet and the remote location.

3. The downhole pressure operated valve assembly according to claim 1, wherein the release member is moveable in a first direction from the locking position to the first intermediate position, and moveable in a second direction from the first intermediate position to the release position.

4. The downhole pressure operated valve assembly according to claim 1, wherein the release member is moveable over a first distance between the locking position and the first intermediate position, and moveable over a second distance between the first intermediate position and the release position, wherein the second distance is larger than the first distance.

5. The downhole pressure operated valve assembly according to claim 1, wherein the locking arrangement extends laterally between the valve member and the release member.

6. The downhole pressure operated valve assembly according to claim 1, wherein the locking arrangement comprises at least one locking member which extends between the valve member and the release member.

7. The downhole pressure operated valve assembly according to claim 1, wherein the locking arrangement engages a locking profile provided on the valve member to lock the valve member in the closed position.

8. The downhole pressure operated valve assembly according to claim 7, wherein the release member defines a locking surface, wherein when the locking arrangement is aligned with the locking surface the locking arrangement is held in engagement with the locking profile of the release member.

9. The downhole pressure operated valve assembly according to claim 7, wherein the release member defines a release surface, wherein when the release member is moved during the first pressure event the release surface becomes aligned with the locking arrangement, to permit movement of the locking member from the locking profile of the valve member.

10. The downhole pressure operated valve assembly according to claim 1, wherein the locking arrangement comprises a plurality of stacked locking members extending between the release member and valve member.

11. The downhole pressure operated valve assembly according to claim 1, wherein the valve member is operable to be moved in response to the second pressure event from the closed position to a second intermediate position, prior to being moved to the open position, wherein the actuation fluid outlet remains closed by the valve member when said valve member is located in the second intermediate position.

12. The downhole pressure operated valve assembly according to claim 11, wherein the valve member is operable to move from the closed position to the second intermediate position in response to a period of increasing or increased pressure, and subsequently moved from the second intermediate position to the open position in response to a period of decreasing or decreased pressure.

13. The downhole pressure operated valve assembly according to claim 11, wherein the valve member is moveable in a first direction from the closed position to the second intermediate position, and moveable in a second direction from the second intermediate position to the open position.

14. The downhole pressure operated valve assembly according to claim 11, wherein the valve member is moveable over a first distance between the closed position and the second intermediate position, and moveable over a second distance between the second intermediate position and the open position, wherein the second distance is larger than the first distance.

15. The downhole pressure operated valve assembly according to claim 1, comprising a flow path extending between the actuation fluid inlet and outlet, wherein the locking arrangement is at least partially located with this flow path.

16. The downhole pressure operated valve assembly according to claim 1, comprising a pressure transfer arrangement for facilitating transfer of pressure within a region of a wellbore and a source of actuation fluid.

17. The downhole pressure operated valve assembly according to claim 1, comprising a biasing arrangement for biasing the release member in one direction.

18. The downhole pressure operated valve assembly according to claim 1, comprising a biasing arrangement for biasing the valve member in one direction, wherein the biasing arrangement comprises a fluid biasing arrangement and opposing sides of the valve member are exposed to a fluid biasing arrangement.

19. The downhole pressure operated valve assembly according to claim 18, wherein a first side of the valve member defines a first sealing area and a second side of the valve member defines a second sealing area, wherein the first and second sealing areas are exposed to the fluid biasing arrangement.

20. The downhole pressure operated valve assembly according to claim 19, wherein the first and second sealing areas are different such that a bias effect in one direction is achieved from the fluid biasing arrangement.

21. The downhole pressure operated valve assembly according to claim 20, wherein an intermediate region between the first and second sealing areas is in pressure communication with the actuation fluid inlet of the valve assembly.

22. A method for downhole actuation, comprising:

providing a valve member of a pressure operated valve assembly in a closed position in which an actuation fluid outlet is closed to prevent actuation fluid from reaching a target location;

locking the valve member in the closed position by use of a locking arrangement and a release member;

communicating fluid from a fluid source to an actuation fluid inlet of the pressure operated valve assembly;

operating the release member to unlock the valve member by establishing a first predetermined pressure event associated with at least the actuation fluid inlet, moving the release member in response to the first pressure event from a locking position in which the locking arrangement is held locked to a release position in which the locking arrangement is released, moving the release member in response to the first pressure event from the locking position to an intermediate position prior to being moved to the release position, retaining the locking arrangement in a locked configuration when said release member is located in the intermediate position, and moving the release member from the locking position to the intermediate position in response to a period of increasing or increased pressure, and subsequently moving the release member from the intermediate position to the release position in response to a period of decreasing or decreased pressure; and establishing a second predetermined pressure event associated with at least the actuation fluid inlet to operate the valve member to move to an open position and permit actuation fluid to flow from the fluid source to the target location.

23. The method according to claim 22, wherein at least one pressure event is achieved by pressure directly applied at the actuation fluid inlet.

24. The method according to claim 22, wherein at least one pressure event is achieved by application of a pressure differential with reference to the pressure at the actuation fluid inlet.

25. The method according to claim 22, wherein the first and second pressure events are sequential.

26. The method according to claim 22, wherein at least one of the first and second pressure events comprises a pressure variation.

27. The method according to claim 22, wherein at least a portion of the second pressure event is defined during the first pressure event.

* * * * *